US011027940B2

(12) United States Patent
Kato et al.

(10) Patent No.: US 11,027,940 B2
(45) Date of Patent: Jun. 8, 2021

(54) WINDING UNIT AND SPIRAL ELECTRIC WIRE MANUFACTURING METHOD

(71) Applicant: Yazaki Corporation, Tokyo (JP)

(72) Inventors: Yasunori Kato, Makinohara (JP); Kazuhiko Takada, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 59 days.

(21) Appl. No.: 16/389,189

(22) Filed: Apr. 19, 2019

(65) Prior Publication Data

US 2020/0002119 A1 Jan. 2, 2020

(30) Foreign Application Priority Data

Jun. 28, 2018 (JP) ..... JP2018-122711

(51) Int. Cl.

*B65H 54/58* (2006.01)
*B65H 61/00* (2006.01)
*B65H 54/71* (2006.01)

(52) U.S. Cl.

CPC ..... *B65H 54/58* (2013.01); *B65H 54/71* (2013.01); *B65H 61/00* (2013.01); *B65H 2701/36* (2013.01)

(58) Field of Classification Search

CPC ..... B65H 54/56; B65H 54/58; B65H 54/71; B65H 61/00; B65H 2701/36

See application file for complete search history.

(56) References Cited

FOREIGN PATENT DOCUMENTS

| | | | |
|---|---|---|---|
| DE | 42 35 007 | A1 | 4/1994 |
| JP | H069150 | A | 1/1994 |
| JP | H09136767 | A | 5/1997 |
| JP | 2010-092788 | A | 4/2010 |
| JP | 2018063812 | A | 4/2018 |
| KR | 10-1418493 | B1 | 7/2014 |
| NL | 1024623 | C2 | 4/2005 |

*Primary Examiner* — William E Dondero

(74) *Attorney, Agent, or Firm* — Sughrue Mion, PLLC

(57) ABSTRACT

A winding device capable of easily winding an electric wire and a method of manufacturing a spiral electric wire are provided. The electric wire delivered by the delivery device is guided by the guide device toward the center portion of the projecting portion. The projecting portion of the winding device has an inclined surface whose outer diameter increases toward the base portion from the tip end on its outer peripheral surface. As a result, the electric wire can be wound around the projecting portion by utilizing the force of the delivery device, and the electric wire can be easily wound up.

5 Claims, 6 Drawing Sheets

WINDING UNIT AND SPIRAL ELECTRIC WIRE MANUFACTURING METHOD

TECHNICAL FIELD

The present invention relates to a winding device for winding an electric wire and a method for manufacturing a spiral electric wire.

BACKGROUND ART

In general, a wiring harness used for a vehicle or the like is manufactured by performing various processing on electric wires. When processing the electric wire, it is necessary to hold the electric wire in an appropriate form. Therefore, a wire-holding bar having a pair of elastic clamping pieces has been proposed (for example, refer to Patent Literature 1). In the wire-holding bar described in Patent Literature 1, the protruding dimensions of a pair of elastic clamping pieces can be adjusted so that electric wires of various electric wire diameters can be clamped.

PRIOR ART DOCUMENT

Patent Literature

Patent Literature 1: JP 2010-92788 A

SUMMARY OF INVENTION

Technical Problem

In wire processing steps, particularly in the case of elongated electric wires, it is preferable to bundle electric wires and convey them. That is, it is preferable that the wire is wound up into an annular (spiral) shape and an end portion of the electric wire is held by a holding member (for example, the wire-holding bar as described in Patent Literature 1). However, although it is easy to hold the end portion of the electric wire, it is not easy to wind the electric wire, and a lot of man-hours are required.

An object of the present invention is to provide a winding unit capable of easily winding an electric wire and a method of manufacturing a spiral electric wire.

Solution to Problem

According to the present invention, there is provided a winding unit for winding an electric wire comprising:

a delivery device for delivering the electric wire in a longitudinal direction;

a hold device for holding a winding start portion of the electric wire;

a winding device having a base portion and a projecting portion projecting from the base portion; and a guide device for guiding the electric wire delivered by the delivery device so as to travel from a tip of the projecting portion toward the base portion, wherein the projecting portion has an inclined surface whose outer diameter increases toward the base portion from the tip end on an outer peripheral surface thereof, and wherein the guide device guides the electric wire toward the center of the tip.

Effect of the Invention

According to the winding unit of the present invention as described above, the electric wire is wound around the projecting portion of the winding device as follows. The electric wire delivered by the delivery device and guided by the guide device travels from the tip of the projecting portion toward the base portion. Since the projecting portion has the inclined surface, the electric wire moves toward the base portion while moving radially outwardly along the inclined surface.

The wire that has reached the base portion is pressed against the base portion by the force that the delivery device tries to deliver and a bending force acts the electric wire. The electric wire tries to escape from the bending force, but since the guide device guides the electric wire toward the center of the tip of the projecting portion, the electric wire is difficult to deform so as to move radially outward (away from the center portion). Accordingly, the electric wire starts to move along the circumferential direction and is wound around the projecting portion. In this way, it is possible to wind the electric wire around the projecting portion by utilizing the delivering force of the delivery device, and the electric wire can be easily wound up.

DESCRIPTION OF EMBODIMENTS

Figure 1:
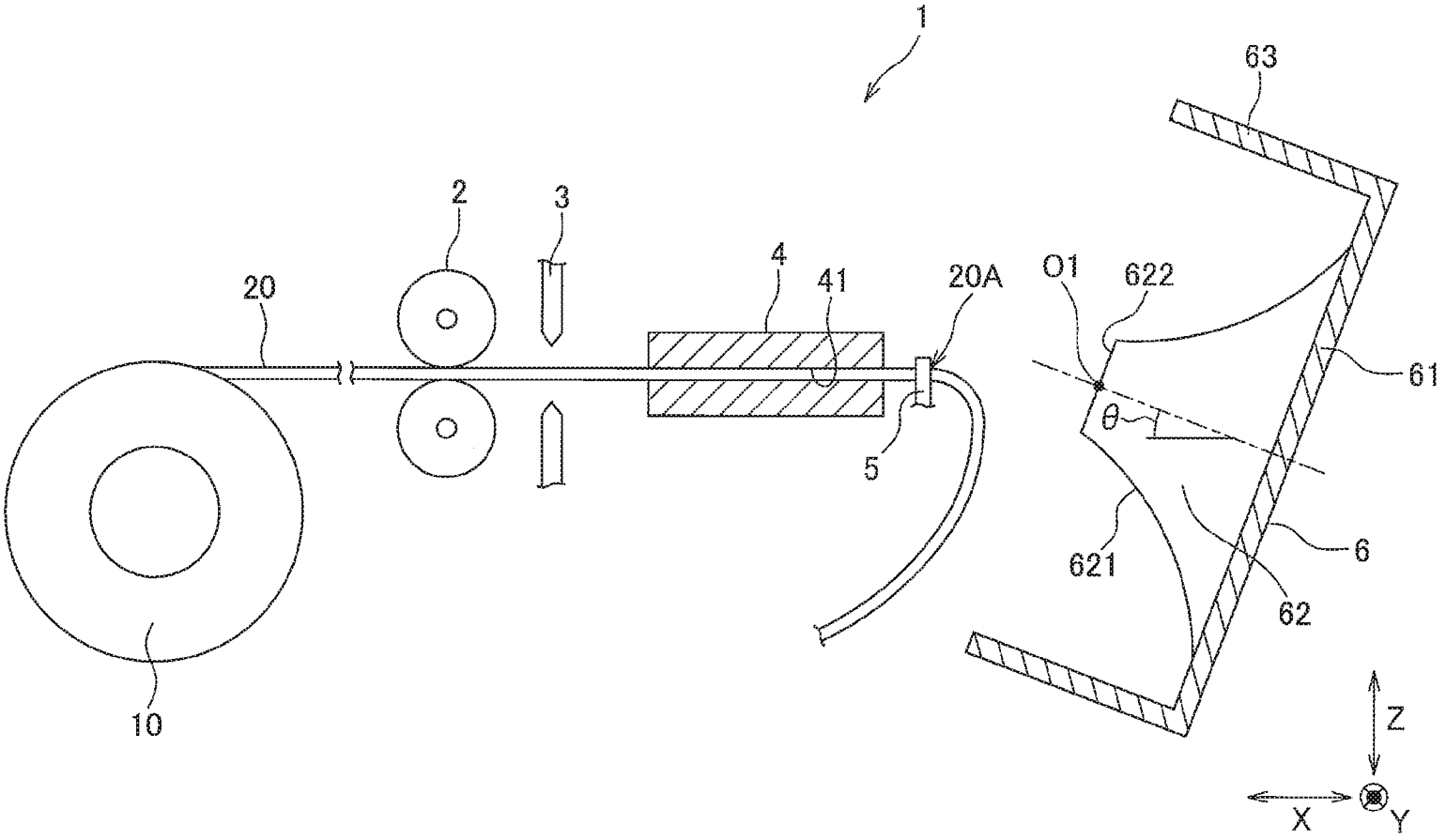
FIG. 1 is a partial cross-sectional view showing a winding unit according to an embodiment of the present invention.
Figure 2:
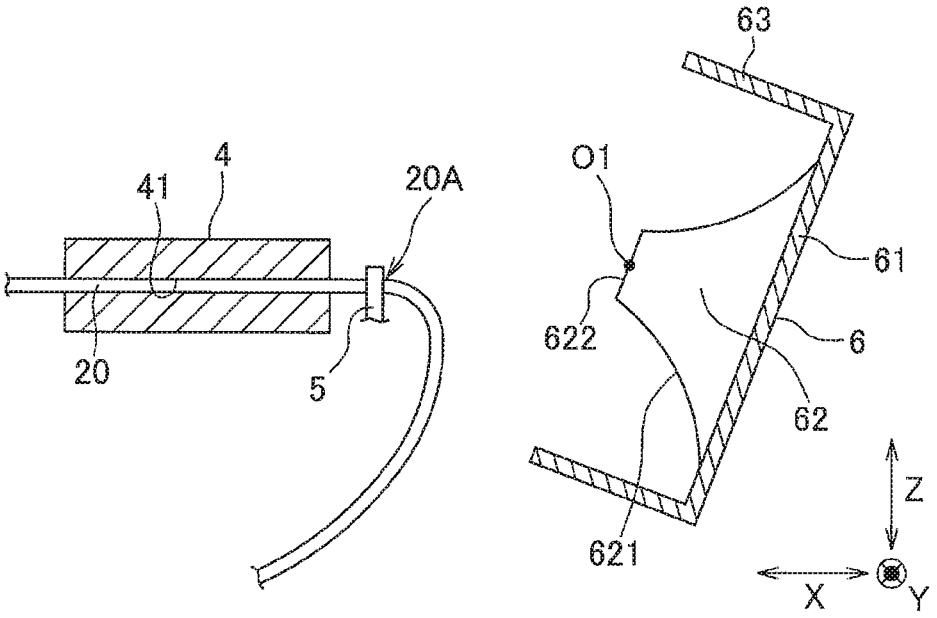
FIG. 2 is a partial cross-sectional view showing how winding of an electric wire is started in the winding unit.
Figure 3:
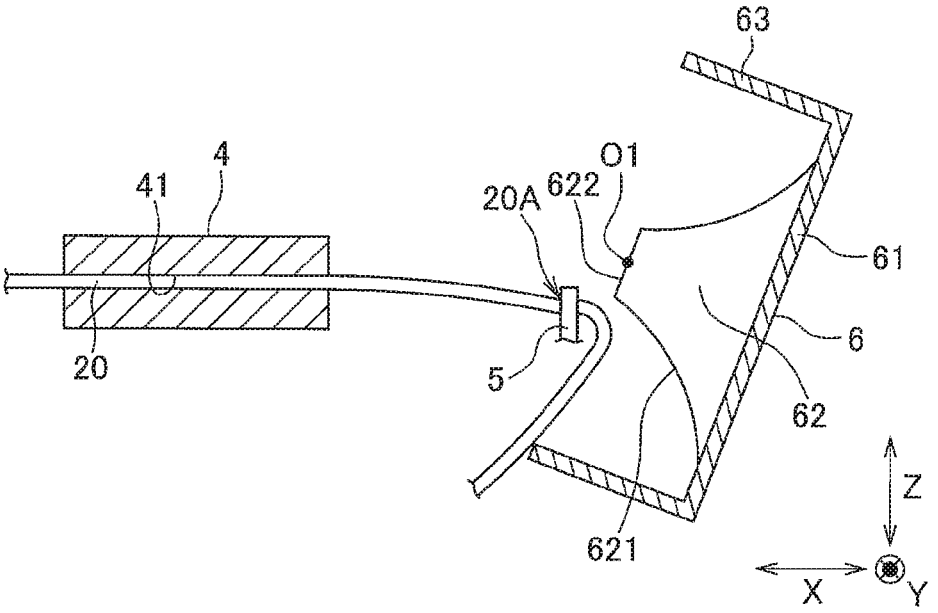
FIG. 3 is a partial cross-sectional view showing a state in which a hold device is moved in the winding unit.
Figure 4:
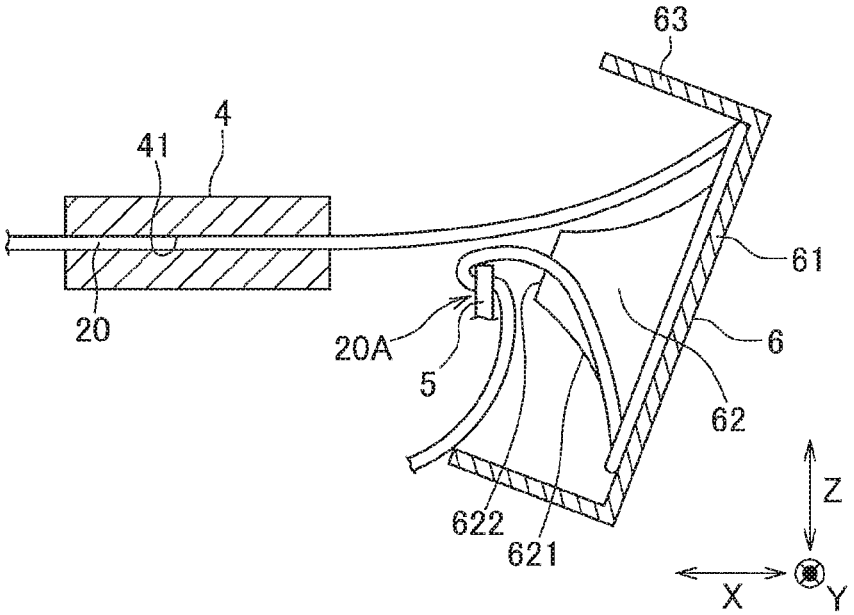
FIG. 4 is a partial cross-sectional view showing how the electric wire is wound up in the winding unit.
Figure 5:
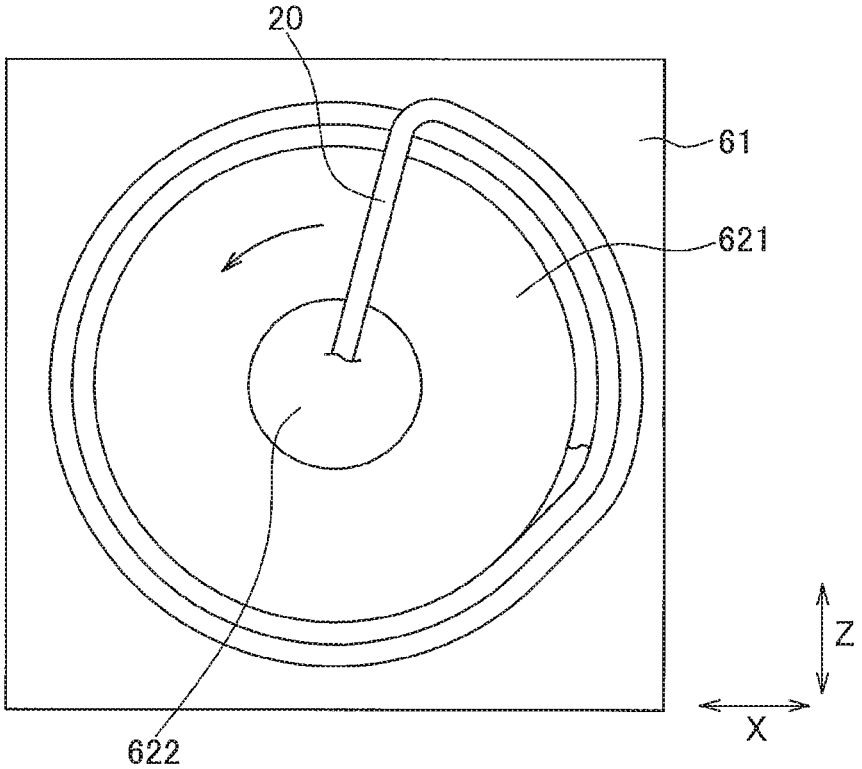
FIG. 5 is a front view showing how the electric wire is wound around the winding device of the winding unit.
Figure 6:
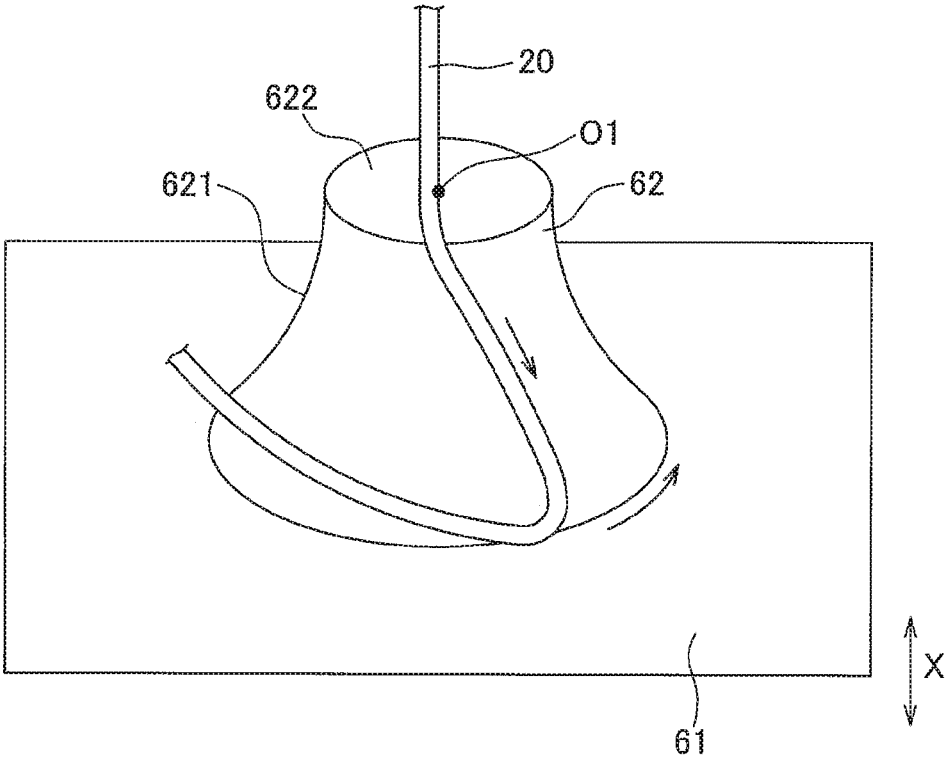
FIG. 6 is a perspective view showing how the electric wire is wound around the winding device.
Figure 7:
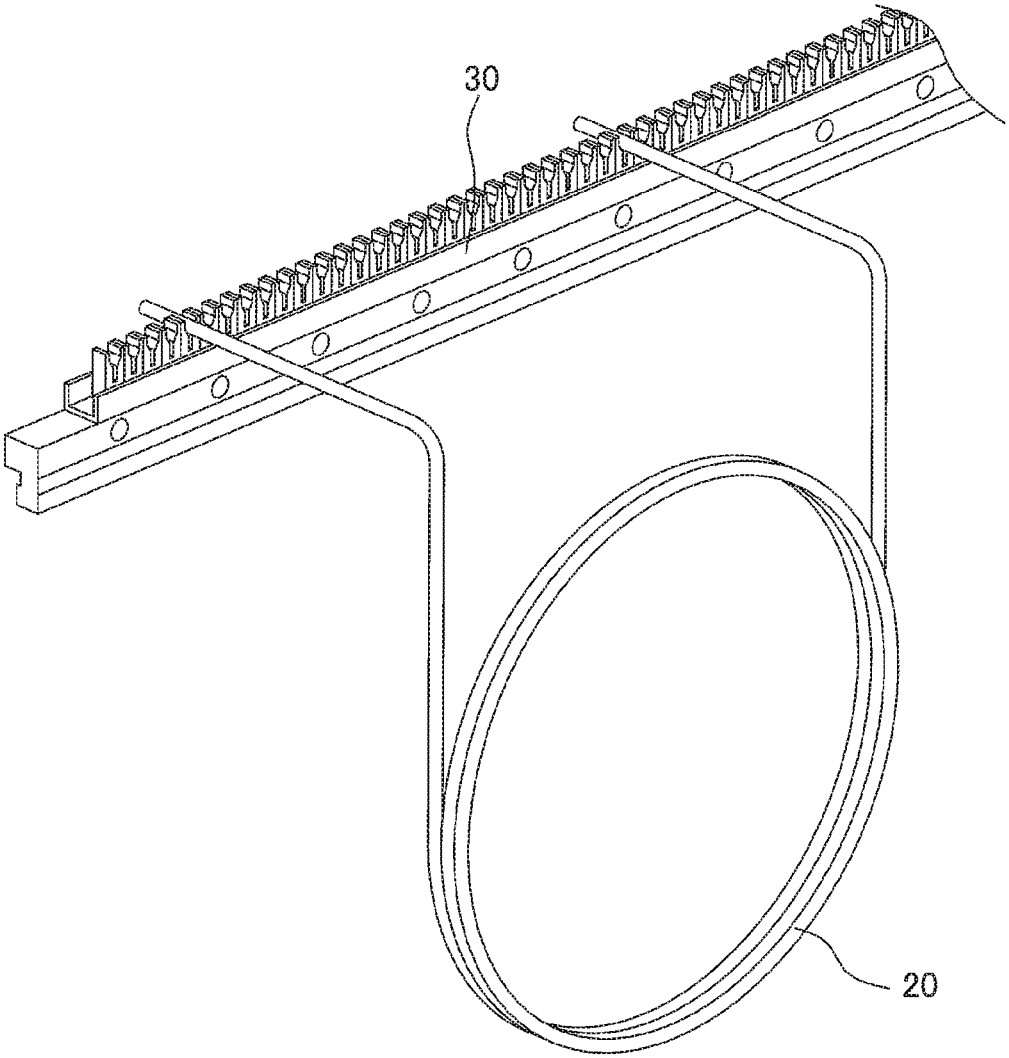
FIG. 7 is a perspective view showing a state in which the electric wire is held by the hold device.

Hereinafter, embodiments of the present invention will be described with reference to the drawings. FIG. 1 is a partial cross-sectional view showing a winding unit 1 according to an embodiment of the present invention; FIG. 2 is a partial cross-sectional view showing how winding of an electric wire 20 is started in the winding unit 1; FIG. 3 is a partial cross-sectional view showing a state in which a hold device 5 is moved in the winding unit 1; FIG. 4 is a partial cross-sectional view showing how the electric wire 20 is wound up in the winding unit 1; FIG. 5 is a front view showing how the electric wire 20 is wound around the winding device 6 of the winding unit 1; FIG. 6 is a perspective view showing how the electric wire 20 is wound around the winding device 6; and FIG. 7 is a perspective view showing a state in which the electric wire 20 is held by a hold member 30.

As shown in FIG. 1, the winding unit 1 of the present embodiment includes a delivery device 2, a cut device 3, a guide device 4, a hold device 5, an initial position determining device, and a winding device 6. The winding unit 1 cuts the electric wire 20 wound around a drum 10 to a predetermined length and, as shown in FIG. 7, and holds the electric wire 20 with the hold member (rod) 30. In the present embodiment, a vertical direction is Z direction, and two directions within a horizontal plane are X direction and Y direction.

The delivery device 2 is, for example, constituted by a pair of rollers sandwiching the electric wire 20 from the Z direction, and delivers the electric wire 20 wound around the drum 10 in the longitudinal direction and advances along the X direction. The delivery device 2 has a scale function for measuring the delivery length of the electric wire 20. In other words, the winding unit 1 is additionally provided to a measuring device for cutting the electric wire to a predetermined length.

The cut device 3 has, for example, a cutting blade, and cuts the electric wire 20 delivered by the delivery device 2 and measured to a predetermined length.

The guide device 4 has a tubular shape extending along the X direction and having an insertion portion 41 through which the electric wire 20 is inserted. That is, the guide means 4 guides the electric wire 20 so as to move along the X direction.

The hold device 5 is constituted by, for example, a chuck which sandwiches the electric wire 20, and is moved in the X direction, for example, by the initial position determining device.

The winding device 6 has a disc-shaped base portion 61, a projecting portion 62 projecting from the base portion 61, and a wall portion 63 standing from the outer peripheral edge of the base portion 61 and surrounding the projecting portion 62. The projecting portion 62 is formed in, for example, a truncated cone shape and has an inclined surface 621 whose outer diameter increases toward the base portion 61 from the tip end on the outer peripheral surface thereof. In the present embodiment, the inclined surface 621 is curved when viewed from the Y direction (the inclination angle with respect to the base portion 61 becomes closer to vertical as headed toward the distal end side). However, the inclination angle of the inclined surface with respect to the base portion 61 may be substantially constant. The projecting portion 62 has a circular upper surface 622 at its tip end.

A projecting direction of the projecting portion 62 is inclined at a predetermined inclination angle θ (for example, 30°) with respect to the X direction. The electric wire 20 that has passed through the guide device 4 travels toward the projecting portion 62, but it hangs down by gravity until it reaches the projecting portion 62. The inclination angle θ is set such that an advancing direction of the hanging electric wire 20 substantially coincides with the projecting direction of the projecting portion 62. That is, the inclination angle θ may be appropriately set according to a delivery speed of the delivery device 2, a distance between an exit of the guide device 4 and the projecting portion 62, flexibility of the electric wire 20, and the like, and is preferably 0 to 90°, and more preferably 0 to 45°. The base portion 61 is inclined with respect to the Z direction by the same inclination angle θ.

Next, a positional relationship of each part of the winding unit 1 will be described. The drum 10, the delivery device 2, the cut device 3, the guide device 4 and the winding device 6 are arranged in this order from one side in the X direction (the left side in FIG. 1). As a result, the electric wire 20 delivered by the delivery device 2 toward the other side (the right side in FIG. 1) in the X direction is further guided to the other side in the X direction by the guide device 4 toward the projecting portion 62 of the winding device. The projecting portion 62 projects from the base portion 61 toward the one side in the X direction.

The insertion portion 41 of the guide device 4 is arranged at substantially the same position in the Y direction with respect to the center O1 of the upper surface 622 of the projecting portion 62 and is arranged somewhat above in the Z direction. As a result, the electric wire 20 traveling from the guide device 4 toward the projecting portion 62 hangs down due to gravity, so that the electric wire 20 goes toward the center O1. That is, the guide device 4 guides the electric wire 20 toward the center of the tip of the projecting portion 62. Incidentally, the position at which the electric wire 20 reaches the projecting portion 62 is only required to be inside the outermost portion (base end portion) of the inclined surface 621, and may be slightly deviated from the center O1.

Hereinafter, the procedure for winding the electric wire 20 by the winding unit 1 (that is, manufacturing the spiral electric wire) and the operation of each part will be described. First, prior to delivering the electric wire 20, as shown in FIG. 2, the electric wire 20 is held by the hold device 5 in the vicinity of the exit of the guide device 4. Therefore, the hold device 5 holds a winding start portion 20A of the electric wire 20. Incidentally, the end portion of the electric wire 20 on the winding start side may be held by the hold member 30 shown in FIG. 7. Next, as shown in FIG. 3, the initial position determining device moves the hold device 5 so as to approach the winding device 6 from an exit of the guide device 4, and locates it in the vicinity of an outer edge of the upper surface 622 of the projecting portion 62.

Next, the electric wire 20 is delivered by the delivery device 2. As a result, as shown in FIGS. 4 and 5, the electric wire 20 reaches the base portion 61 and is wound around the projecting portion 62. When the electric wire 20 is delivered by a predetermined length, the delivery device 2 stops delivering and the cut device 3 cuts the electric wire 20. The end portion of the electric wire 20 on the winding end side is held by the hold member 30 and the electric wire 20 is pulled out from the projecting portion 62. As a result, as shown in FIG. 7, the electric wire 20 is wound up and both ends are held. The electric wire 20 is conveyed to the next process in a state of being wound up in this way.

Here, a detailed operation when the electric wire 20 is wound by the projecting portion 62 will be described. The electric wire 20 delivered by the delivery device 2 and guided by the guide device 4 travels from a distal end of the projecting portion 62 toward the base portion 61. Since the projecting portion 62 has the inclined surface 621, the electric wire 20 moves toward the base portion 61 while moving radially outwardly along the inclined surface 621.

As shown in FIG. 6, since the electric wire 20 that has reached the base portion 61 is pressed against the base portion 61 by the force that the delivery device 2 is going to deliver, a bending force acts. The electric wire 20 tries to escape from the bending force, but since it is guided toward the center portion of the projecting portion 62 by the guide device 4, it is difficult for the electric wire 20 to deform so as to face radially outward (away from the center portion). Therefore, the electric wire 20 starts to move along the circumferential direction and is wound around the projecting portion 62.

Since the electric wire 20 is wound around the drum 10, it has a curling tendency and is easy to bend in a predetermined direction. Therefore, a rotational direction when the electric wire 20 moves in the circumferential direction is determined by the relationship between the winding start portion 20A held by the hold device 5 and the easy bending direction of the electric wire 20. As described above, the electric wire 20 is wound around the projecting portion 62, whereby the spiral electric wire is manufactured.

According to this embodiment as described above, there are the following effects. That is, the electric wire 20 delivered by the delivery device 2 is guided by the guide device 4 toward the center portion of the projecting portion 62. Along with this, the projecting portion 62 has the inclined surface 621 on the outer peripheral surface. As a result, the electric wire 20 can be wound around the projecting portion 62 by utilizing the force of the delivery device 2, and the electric wire 20 can be easily wound up.

Further, the hold device 5 holding the winding start portion 20A of the electric wire 20 is brought close to the winding device 6 from the exit of the guide means 4 by the initial position determining device. This makes it easy to move the electric wire 20 along the circumferential direction at the beginning of winding.

Further, the guide device 4 advances the electric wire 20 in the X direction which is the horizontal direction, and the projecting direction of the projecting portion 62 is inclined with respect to the X direction. This makes it easy for the advancing direction of the hanging electric wire 20 and the projecting direction of the projecting portion 62 to substantially coincide with each other, so that the electric wire 20 can be easily wound around the projecting portion 62.

Further, since the delivery device 2 has the measuring scale function, the measuring device can be used as the delivery device 2. Therefore, as compared with a configuration in which the measuring device and the delivery device are provided independently, the entire winding unit 1 can be simplified.

Incidentally, the present invention is not limited to the above-described embodiment, but includes other configurations and the like that can achieve the object of the present invention, and the following modifications and the like are also included in the present invention.

For example, in the above-described embodiment, the electric wire 20 is wound around the projecting portion 62 only by the delivery force of the delivery device 2, but an auxiliary mechanism for winding the electric wire 20 on the projecting portion 62 may be provided. For example, as shown in FIG. 8, the winding unit may be provided with a circulation guide device 7 for guiding the electric wire 20 guided by the guide device 4.

Figure 8:
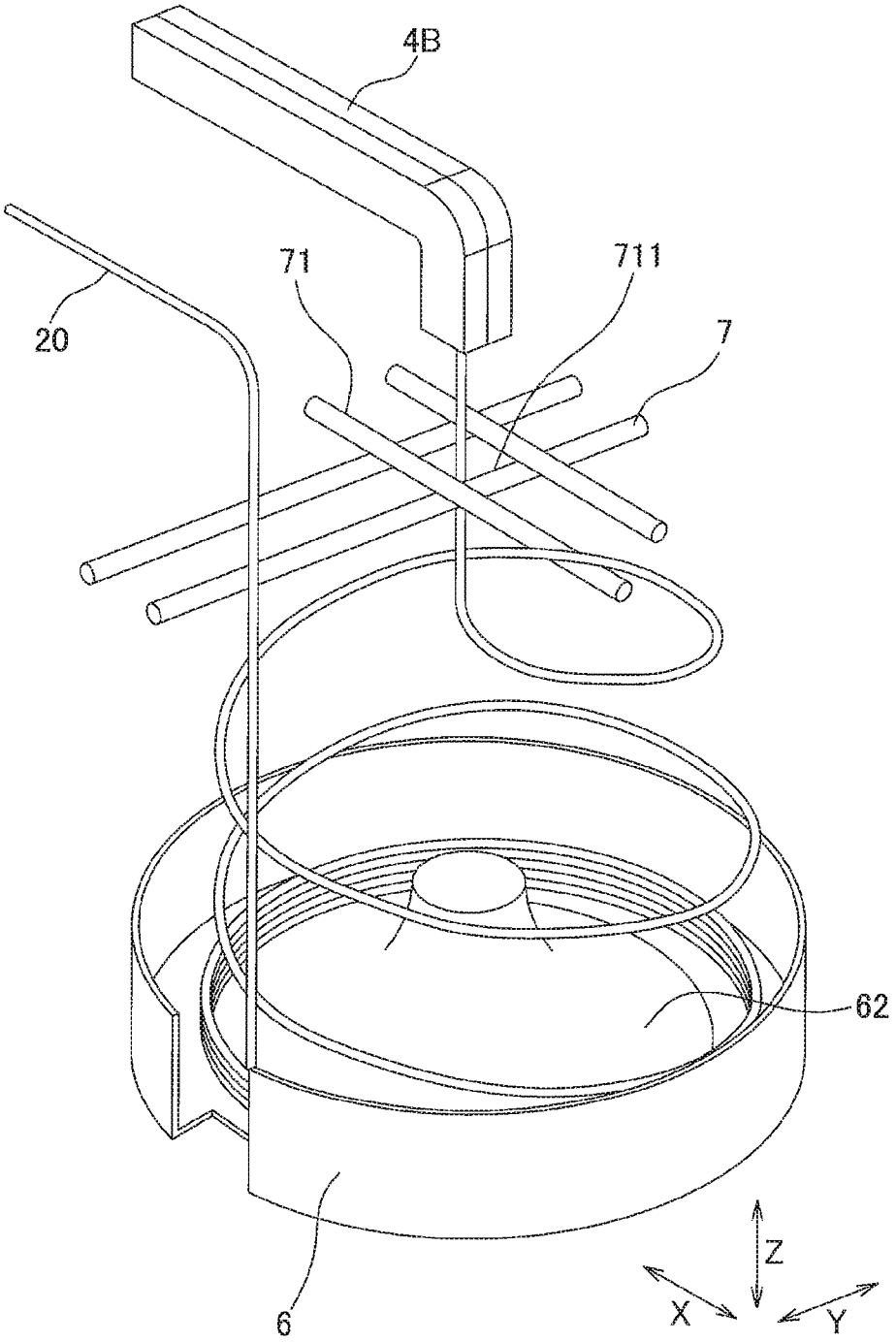
FIG. 8 is a perspective view showing the winding unit according to a modification of the present invention.

In the configuration shown in FIG. 8, the guide device 4B is formed in an L shape, thereby changing the traveling direction so that the electric wire 20 delivered in the X direction is directed downward in the Z direction. Incidentally, when the guide device 4 which does not change the traveling direction is used as in the above embodiment, the circulation guide device may be provided. Further, when the guide device changes the traveling direction, the traveling direction after the change is not limited to the Z direction.

The circulation guide device 7 has an insertion member 71 and a circulation movement device for moving the circulation guide device 7 on the XY plane. The insertion member 71 has, for example, two rod-shaped members extending along the X direction and two rod-like members extending along the Y direction, and these rod-like members cross each other to form an insertion hole 711. The electric wire 20 is inserted into the insertion hole 711 of the insertion member 71. The circulation moving device is constituted by, for example, an actuator which moves in the X direction and an actuator which moves in the Y direction.

The circulation moving device circulates the insertion member 71 so that the insertion hole 711 overlaps the outer peripheral surface of the projecting portion 62 as seen from the Z direction and the insertion hole 711 circulates around the central portion of the projecting portion 62. Incidentally, the trajectory when the insertion hole 711 circulates may be a circle shape or a polygonal shape. According to the configuration in which the circulation guide device 7 is provided as shown in FIG. 8, the electric wire 20 can be easily wound around the projecting portion 62.

Further, in the above-described embodiment, the hold device 5 for holding the winding start portion 20A of the electric wire 20 is moved by the initial position determining device. However, in the case where the electric wire 20 tends to move along the circumferential direction at the beginning of winding, such as in the case where the hold device 5 is disposed in advance in the vicinity of the winding device 6 or in the case where the exit of the guide device 4 is arranged in the vicinity of the winding device 6, the initial position determining device may be omitted.

Further, in the above embodiment, the projecting direction of the projecting portion 62 is inclined with respect to the X direction which is the horizontal direction. However, the projecting direction of the projecting portion is appropriately set according to the direction in which the guide device guides the electric wire 20, the delivery speed of the electric wire 20, the distance between the guide device and the projecting portion, flexibility of the electric wire, and the like. For example, when the guide device 4 guides the electric wire 20 in the X direction as in the above-described embodiment, when the delivery speed of the electric wire 20 is high, the distance between the guide device and the projecting portion is short and the electric wire is not easily bent, it is hard for the electric wire 20 to hang down due to gravity. Therefore, the projecting direction of the projecting portion 62 does not have to be inclined with respect to the X direction.

In the above-described embodiment, the delivery device 2 has the measuring scale function. However, the delivery device may simply deliver the electric wire or may have other functions.

Further, in the above-described embodiment, the projecting portion 62 is formed in a truncated cone shape. However, the projecting portion may have an inclined surface whose outer diameter increases from the tip toward the base portion, and is not limited to a truncated cone shape. For example, the projecting portion may have a conical shape and not have an upper surface, or may be formed in a pyramidal shape or a truncated pyramid shape. In addition, the entire outer peripheral surface of the protruding portion may not be inclined, and the protruding portion may have an inclined surface in a part of the outer peripheral portion.

Although the best configurations, methods, and the like for carrying out the present invention are disclosed in the above description, the present invention is not limited thereto. That is, the present invention has been particularly shown and described with particular reference to certain embodiments; however, various modifications can be made by those skilled in the art to the above-described embodiments, in shapes, materials, quantities, and other detailed configurations without departing from the spirit and scope of the invention. Accordingly, the description that limits the shape, material, etc. disclosed above is exemplarily described for easy understanding of the present invention, and does not limit the present invention. Therefore, the description of the parts with limitations on part or all of the restrictions on their shapes, materials and the like is included in the present invention.

REFERENCE SIGNS LIST

1 winding unit
2 delivery device

4 guide device
5 hold device
6 winding device
61 base portion
62 projecting portion
621 inclined surface
7 circulation guide device
71 insertion member
711 insertion hole
20 electric wire
20A winding start portion

The invention claimed is:

1. A winding unit for winding an electric wire comprising:

a delivery device for delivering the electric wire in a longitudinal direction;

a hold device for holding a winding start portion of the electric wire;

a winding device having a base portion and a projecting portion projecting from the base portion; and a guide device for guiding the electric wire delivered by the delivery device so as to travel from a tip of the projecting portion toward the base portion, wherein the projecting portion has an inclined surface whose outer diameter increases toward the base portion from the tip end on an outer peripheral surface thereof, wherein the guide device guides the electric wire toward the center of the tip, and wherein while winding, the hold device is positioned between the winding device and the guide device, and the electric wire is wound around the projecting portion.

2. The winding unit as claimed in claim 1, wherein the guide device advances the electric wire along a horizontal direction, and wherein a projecting direction of the projecting portion is inclined with respect to the horizontal direction.

3. The winding unit as claimed in claim 2, wherein the delivery device has a scale function for measuring a delivery length of the electric wire.

4. The winding unit as claimed in claim 1, wherein the delivery device has a scale function for measuring a delivery length of the electric wire.

5. A method of manufacturing helical electric wire for manufacturing spirally wound helical electric wire comprising the steps of:

a delivery step for delivering an electric wire in a longitudinal direction;

a hold step for holding a winding start portion of the electric wire; and a guide step for guiding the delivered electric wire, wherein in the guide step, with respect to a base portion and a projecting portion projecting from the base portion and having an inclined surface whose outer diameter increases toward the base portion from a tip end on an outer peripheral surface thereof, the electric wire is guided toward the center portion of the tip end and advanced toward the base portion from the tip end, and wherein while winding, a hold device is positioned between a winding device and a guide device, and the electric wire is wound around the projecting portion.

* * * * *